US011311153B1

(12) United States Patent
Hsu

(10) Patent No.: US 11,311,153 B1
(45) Date of Patent: Apr. 26, 2022

(54) WIND FLOW GENERATING DEVICE ADAPTED TO HAND DRYER

(71) Applicant: HOKWANG INDUSTRIES CO., LTD., New Taipei (TW)

(72) Inventor: Chi-Chin Hsu, New Taipei (TW)

(73) Assignee: Hokwang Industries Co., Ltd., New Taipei (TW)

( * ) Notice: Subject to any disclaimer, the term of this patent is extended or adjusted under 35 U.S.C. 154(b) by 1 day.

(21) Appl. No.: 17/060,441

(22) Filed: Oct. 1, 2020

(51) Int. Cl.

| | |
|---|---|
| ***F04D 25/08*** | (2006.01) |
| ***A47K 10/48*** | (2006.01) |
| ***F04D 25/12*** | (2006.01) |
| ***F04D 29/28*** | (2006.01) |
| ***F04D 25/06*** | (2006.01) |
| *F04D 17/16* | (2006.01) |
| *F04D 29/44* | (2006.01) |

(52) U.S. Cl.
CPC ..... *A47K 10/48* (2013.01); *F04D 25/06* (2013.01); *F04D 25/08* (2013.01); *F04D 25/12* (2013.01); *F04D 29/281* (2013.01); *F04D 17/165* (2013.01); *F04D 29/441* (2013.01)

(58) Field of Classification Search
CPC ..... F04D 29/44–441; F04D 29/444; F04D 25/06; F04D 25/08; F04D 17/165; A47K 10/48
See application file for complete search history.

(56) References Cited

U.S. PATENT DOCUMENTS

| | | | | |
|---|---|---|---|---|
| 4,111,615 | A * | 9/1978 | Watanabe | A47L 5/22 415/119 |
| 4,767,285 | A * | 8/1988 | Jyoraku | F04D 25/06 417/366 |
| 6,851,928 | B2 * | 2/2005 | Tam | A47L 5/22 415/211.2 |
| D534,645 | S * | 1/2007 | Tateishi | F04D 29/24 D23/411 |
| 2014/0147311 | A1 * | 5/2014 | Jung | F04D 17/16 417/423.12 |
| 2014/0294578 | A1 * | 10/2014 | Oh | F04D 29/4206 415/208.1 |
| 2017/0051756 | A1 * | 2/2017 | Fang | F04D 29/281 |
| 2018/0160872 | A1 * | 6/2018 | Hayamitsu | F04D 29/441 |

(Continued)

FOREIGN PATENT DOCUMENTS

TW 201817978 A 5/2018

*Primary Examiner* — Devon C Kramer
*Assistant Examiner* — Thomas Fink
(74) *Attorney, Agent, or Firm* — Muncy, Geissler, Olds & Lowe, P.C.

(57) ABSTRACT

A wind flow generating device adapted to a hand dryer includes an electric motor provided with a motor housing and a driving shaft, a wind barrel including a bowl, a rotatable fan blade connected with the driving shaft for generating an airflow, and a guide frame fixed to the motor housing. An air outlet gap is jointly defined by the motor housing and the bowl, the guide frame includes a support ring fixed to the motor housing, and a plurality of guide vanes formed on the support ring at intervals and extending along a surface of the motor housing. Any adjacent two of the guide vanes define a guide channel along the motor housing. An inlet and an outlet of each guide channel are positioned on different contour lines of the motor housing, and each guide channel guides the airflow to be discharged from the air outlet gap.

9 Claims, 5 Drawing Sheets

(56) References Cited

U.S. PATENT DOCUMENTS

| | | | | |
|---|---|---|---|---|
| 2018/0180058 | A1* | 6/2018 | Hayamitsu | F04D 29/30 |
| 2018/0209442 | A1* | 7/2018 | Sawada | F04D 17/165 |
| 2018/0266426 | A1* | 9/2018 | Lee | F04D 29/5806 |
| 2019/0125146 | A1* | 5/2019 | Ming | F04D 29/24 |
| 2020/0237166 | A1* | 7/2020 | Adachi | F04D 17/16 |
| 2020/0392964 | A1* | 12/2020 | Hwang | F04D 29/023 |
| 2021/0010486 | A1* | 1/2021 | Choi | F04D 29/444 |

* cited by examiner

WIND FLOW GENERATING DEVICE ADAPTED TO HAND DRYER

FIELD OF THE INVENTION

The invention relates to a wind flow generating device, and more particularly, to a wind flow generating device adapted to a hand dryer.

BACKGROUND OF THE INVENTION

Taiwan patent number 201817978A discloses a wind flow generating device of a hand dryer, and the wind flow generating device mainly includes an electric motor, a deflector, a rotatable fan blade, and a housing, wherein the housing is arranged on a side of the electric motor and can accommodate the rotatable fan blade and the deflector, the rotatable fan blade is driven by the electric motor to generate an airflow in the wind flow generating device, the deflector is arranged on a path of the airflow and positioned on a downstream side of the path of the airflow relative to the rotatable fan blade, and the deflector is mainly composed of a main plate, a plurality of first fins provided on the main plate, and a plurality of second fins provided on a side of the main plate opposite to the plurality of first fins. When implemented, the rotatable fan blade is driven to generate the airflow towards the deflector and guided by the plurality of first fins, the airflow is guided by the plurality of first fins towards an outer side of the main plate and impacts the housing, and after impact, the path of the airflow reverses towards the plurality of second fins. After that, the airflow is guided by the plurality of second fins towards the interior or the exterior of the electric motor. However, it can be seen from the foregoing that although the conventional wind flow generating device is provided with the deflector, the conventional deflector guides the airflow towards the outer side of the deflector after receiving the airflow from the rotatable fan blade, so that the airflow impacts the housing and causes turbulence at the position of impact. That is, the conventional deflector fails to effectively reduce the occurrence of turbulence in the airflow.

In addition, in the prior art, after the airflow is guided to flow out through an air outlet of the wind flow generating device, the airflow cannot keep close to the housing of the electric motor because the airflow is guided by the plurality of second fins, as a result, the electric motor cannot exchange heat with the airflow specifically.

SUMMARY OF THE INVENTION

It's an object of the invention to solve the problem that conventional deflectors cannot reduce the occurrence of turbulence.

It's another object of the invention to solve the problem that conventional deflectors cannot direct airflow to dissipate heat from a housing of an electric motor.

To achieve the above objects, the invention provides a wind flow generating device adapted to a hand dryer comprising an electric motor and a wind barrel. The electric motor is provided with a motor housing and a driving shaft. The wind barrel includes a bowl, a rotatable fan blade provided in the bowl and connected with the driving shaft to generate an airflow in the bowl, and a guide frame provided in the bowl and fixed to the motor housing. Wherein an air inlet hole is provided at a bottom of the bowl, and an air outlet gap is jointly defined by the motor housing and an opening of the bowl, the guide frame includes a support ring fixed to the motor housing and a plurality of guide vanes formed on the support ring at intervals and extending along a surface of the motor housing, any adjacent two of the plurality of guide vanes define a guide channel along the motor housing, an inlet and an outlet of each guide channel are positioned on different contour lines of the motor housing, and each guide channel guides the airflow to be discharged from the air outlet gap.

In an embodiment, each of the plurality of guide vanes is provided with a guide lug at a joint of the guide vane and the support ring on a side facing the air outlet gap.

In an embodiment, some of the plurality of guide vanes are provided, on a side facing the opening of the bowl, with a mounting lug at an end of the guide channel close to the air outlet gap, and the mounting lug is formed with a first through hole through which a fixing member is inserted.

In an embodiment, a curvature of each of the plurality of guide vanes on a side facing the air outlet gap and at an end close to the rotatable fan blade is smaller than the curvature of each of the plurality of guide vanes on a side facing the air outlet gap and at an end close to the air outlet gap.

In an embodiment, in each of the plurality of guide vanes, a profile close to the motor housing is different from a profile opposite to the motor housing.

In an embodiment, each of the plurality of guide vanes is inclined from a side opposite to the motor housing to a side close to the motor housing.

In an embodiment, the support ring is provided with a plurality of bearing blocks arranged on an inner side of the support ring at intervals, and a plurality of support columns arranged on the inner side of the support ring and between any adjacent two of the plurality of bearing blocks, respectively, and each of the plurality of bearing blocks is formed with a second through hole through which a coupling member is inserted.

In an embodiment, the motor housing is provided with an end cap within the wind barrel, the end cap being formed with a plurality of assembly notches provided for the bearing blocks and the support columns, respectively.

In an embodiment, the motor housing is provided with an end cap positioned within the wind barrel, the end cap comprises an engagement ring forming the air outlet gap, and the engagement ring is coupled to some of the plurality of guide vanes.

In an embodiment, a plurality of hollowed areas respectively facing the outlets of the guide channels are formed on the engagement ring.

In an embodiment, the guide frame comprises a plurality of support walls joining the support ring and the plurality of guide vanes.

Compared with the prior art, the invention has the following advantages: the guide channel is defined by any adjacent two of the plurality of guide vanes, and the inlet and the outlet of each of the guide channels are positioned on different contour lines of the motor housing. After the rotatable fan blade generates the airflow, the airflow enters the guide frame and can be directly guided by the plurality of guide vanes towards a direction facing the motor housing without bending its path, thereby reducing the occurrence of turbulence of the airflow particularly. In addition, guided by the guide frame, the airflow can dissipate heat from the motor housing while flowing along the motor housing.

DETAILED DESCRIPTION OF THE PREFERRED EMBODIMENTS

Figure 1:
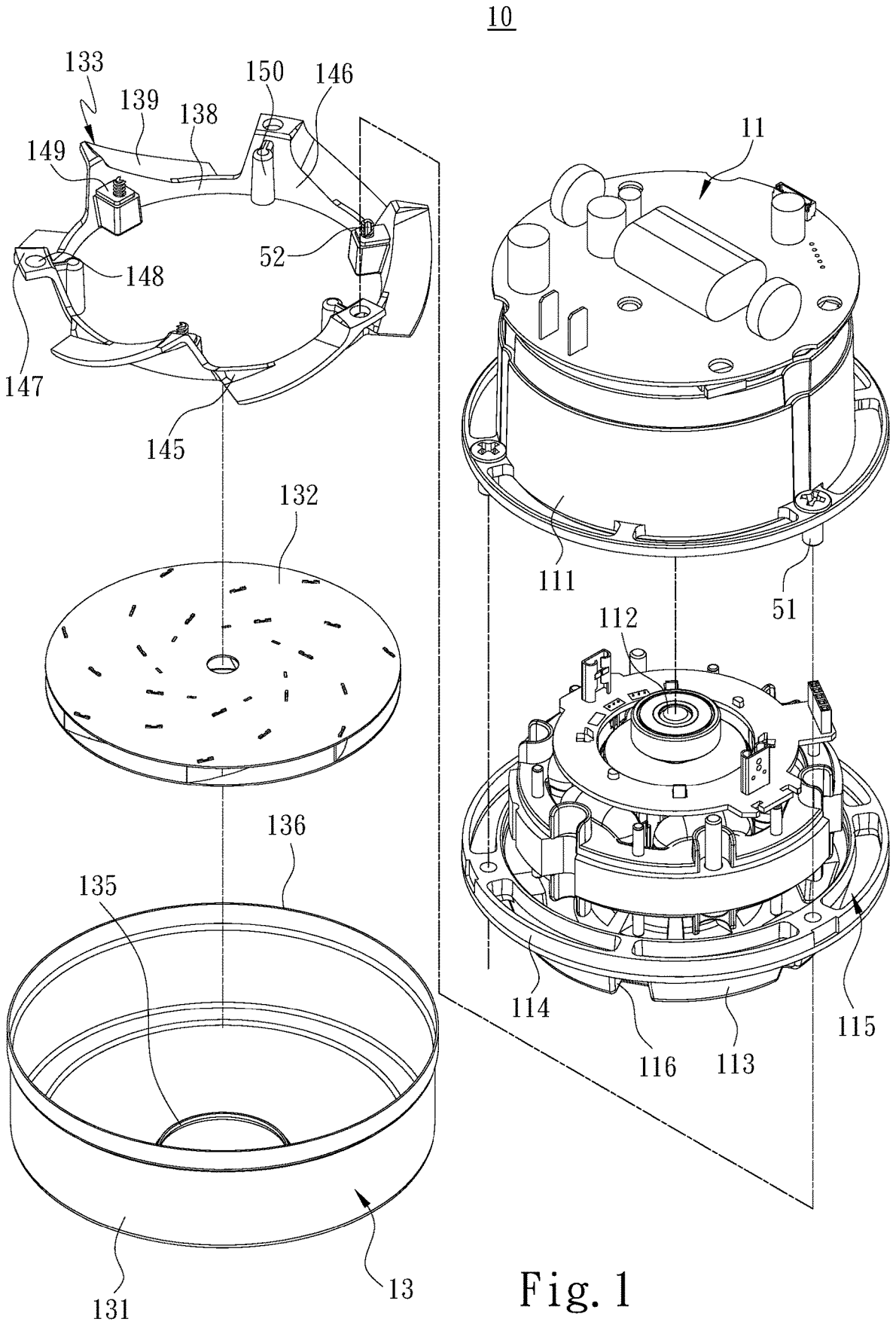
FIG. 1. is a first schematic exploded view of a structure according to an embodiment of the invention.
Figure 2:
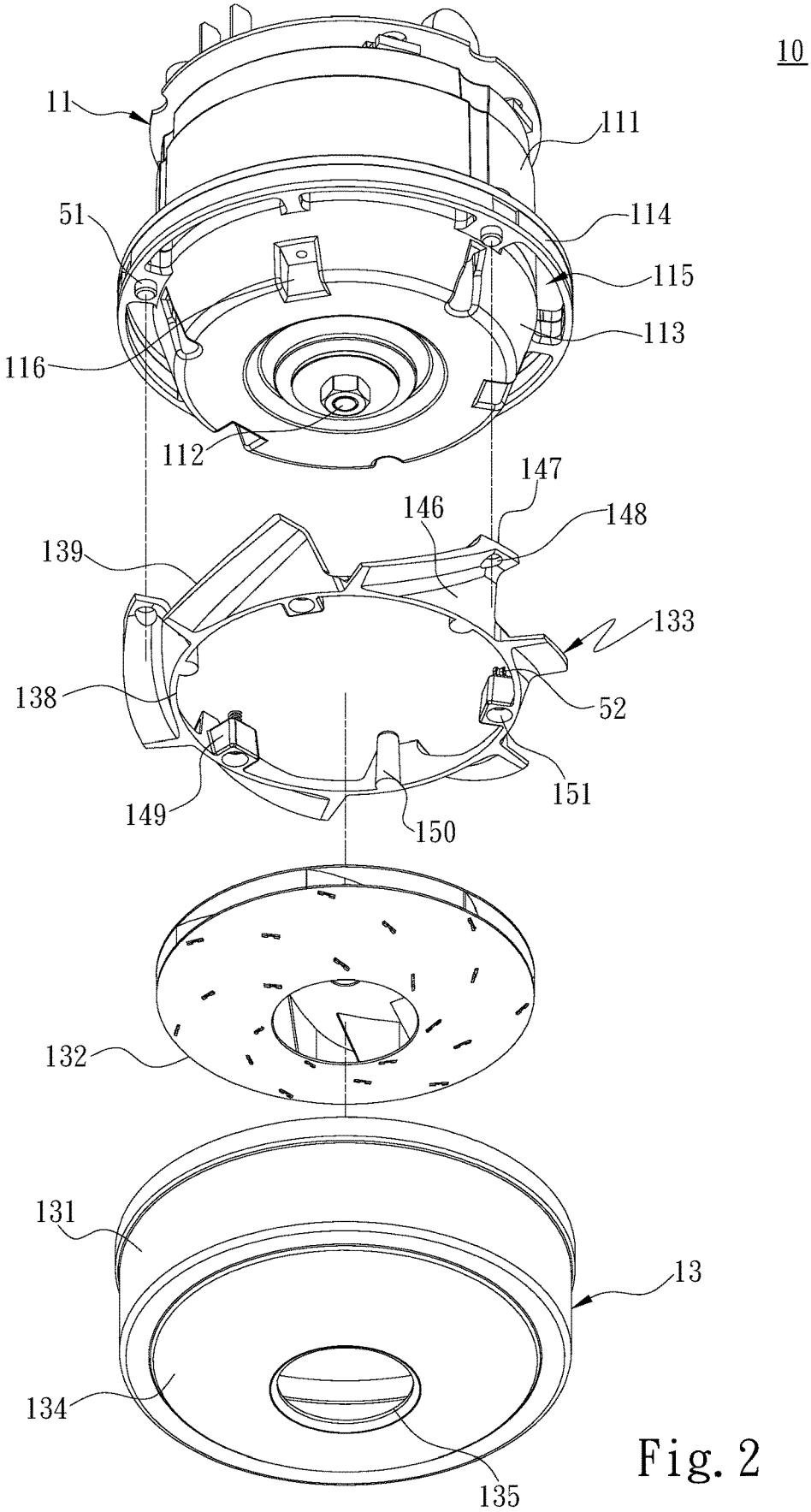
FIG. 2. is a second schematic exploded view of the structure according to an embodiment of the invention.
Figure 3:
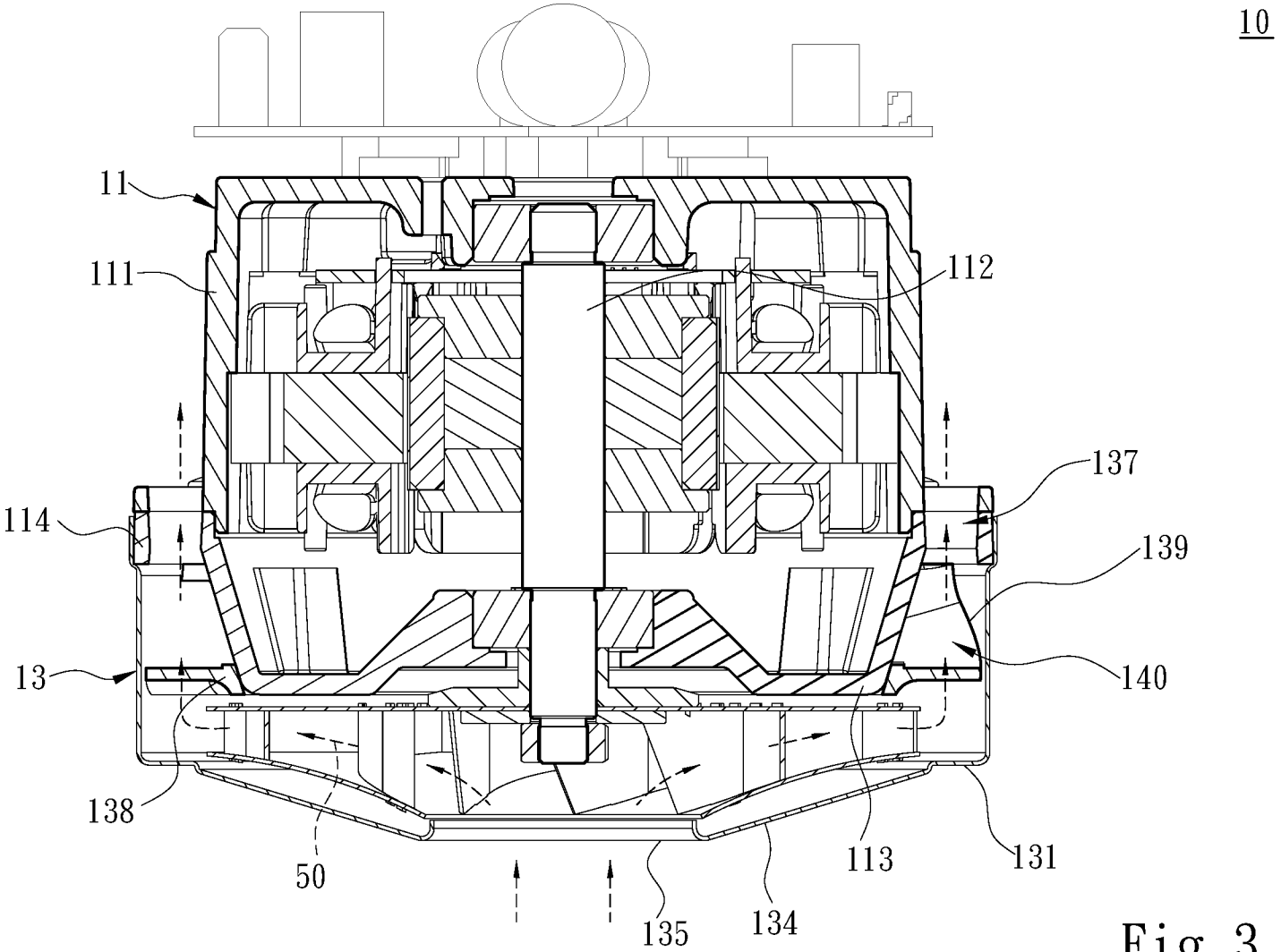
FIG. 3 is a schematic cross-sectional view of a portion of the structure according to an embodiment of the invention.

The technical solutions of the invention will now be described in details with reference to the drawings as follows.

Referring to FIG. 1, FIG. 2, FIG. 3, FIG. 4 and FIG. 5, the invention provides a wind flow generating device 10 that can be adapted to a hand dryer (not shown in the figures), and the wind flow generating device 10 draws ambient air to provide the hand dryer with air to dry a user's hands. The wind flow generating device 10 includes an electric motor 11 and a wind barrel 13. The electric motor 11 includes a motor housing 111 and a driving shaft 112. The motor housing 111 is used for covering and protecting a plurality of internal elements of the electric motor 11. The driving shaft 112 is arranged in the motor housing 111 and is driven to rotate when the electric motor 11 is started. Moreover, the wind barrel 13 is provided on a side of the electric motor 11 and includes a bowl 131, a rotatable fan blade 132, and a guide frame 133. The bowl 131 is connected to the motor housing 111 and is positioned on a side of the electric motor 11. The rotatable fan blade 132 is positioned in the bowl 131 and connected to the driving shaft 112. The rotatable fan blade 132 is driven by the driving shaft 112 to rotate and generates an airflow 50 in the bowl 131 during rotation. Further, the guide frame 133 is positioned in the bowl 131 and fixed to the motor housing 111, and the guide frame 133 serves to receive the airflow 50 and guides the airflow 50 towards a direction facing the electric motor 11.

Figure 4:
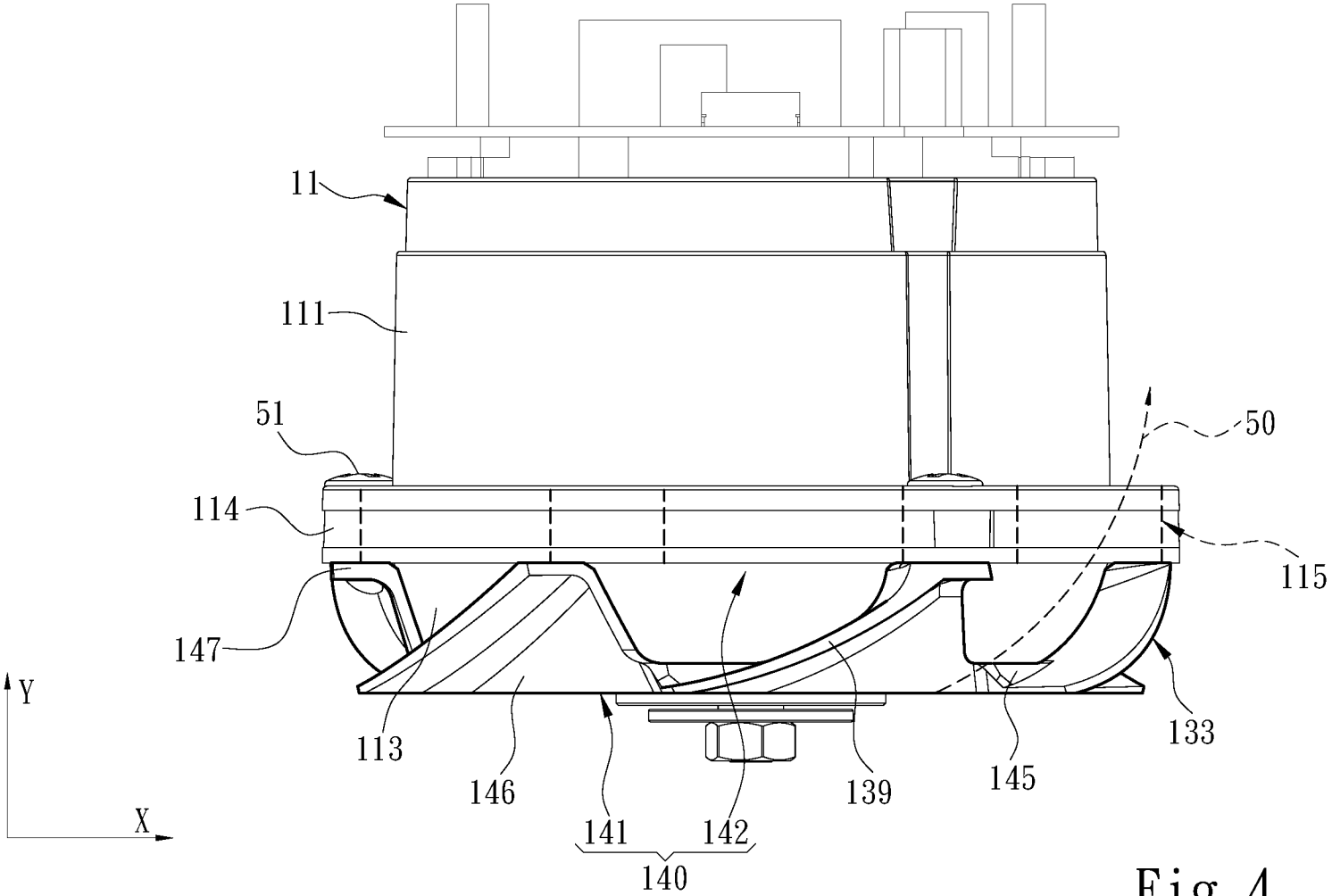
FIG. 4 is a schematic plan view of a guide frame and an electric motor according to an embodiment of the invention.
Figure 5:
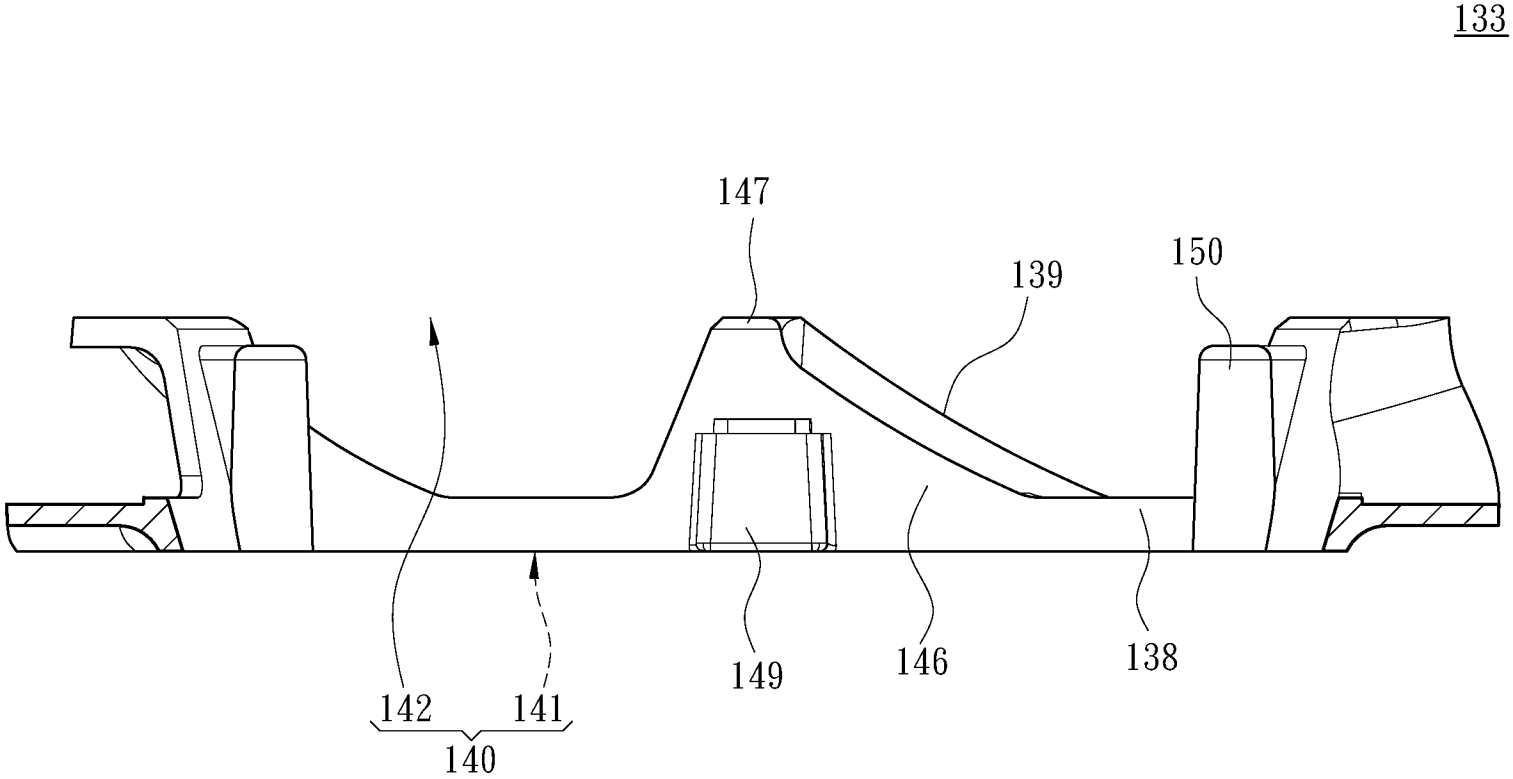
FIG. 5 is a schematic cross-sectional view of a guide frame according to an embodiment of the invention.

Further, a bottom 134 of the bowl 131 is formed with an air inlet hole 135, and an air outlet gap 137 is jointly defined by an opening 136 of the bowl 131 and the motor housing 111. The bottom 134 described here is a side of the bowl 131 opposite to the electric motor 11, and the opening 136 is a side of the bowl 131 facing the electric motor 11. The air inlet hole 135 allows the rotatable fan blade 132 to draw ambient air into the bowl 131 and form the airflow 50 with the ambient air when the rotatable fan blade 132 is started, and the air outlet gap 137 allows the airflow 50 to be discharged from the bowl 131. In an embodiment, a projected area of the air inlet hole 135 is larger than a projected area of the air outlet gap 137, thereby increasing a flow rate of the airflow 50 when discharged from the bowl 131. In another aspect, the guide frame 133 includes a support ring 138 and a plurality of guide vanes 139. The support ring 138 is coupled with the motor housing 111 and fixed to the motor housing 111. The plurality of guide vanes 139 is arranged at intervals on the support ring 138 and extending along a surface of the motor housing 111. Further, in order to guide the airflow 50 in a direction opposite to the rotatable fan blade 132, each of the plurality of guide vanes 139 is designed to be inclined. Specifically, assuming that an end of one of the plurality of guide vanes 139 facing the rotatable fan blade 132 is positioned at the origin of a rectangular coordinate system, an end of the same one of the plurality of guide vanes 139 opposite to the rotatable fan blade 132 extends towards the first quadrant of the rectangular coordinate system. Further, any adjacent two of the plurality of guide vanes 139 define a guide channel 140, and each guide channel 140 is disposed along the motor housing 111, and an inlet 141 and an outlet 142 of each guide channel 140 are positioned on different contour lines of the motor housing 111. The inlet 141 described here refers to a side of each guide channel 140 facing the rotatable fan blade 132 adapted to receive the airflow 50 from the rotatable fan blade 132, and the outlet 142 refers to a side of each guide channel 140 opposite to the rotatable fan blade 132 provided for the airflow 50 having entered the guide channel 140 to be discharged from the air outlet gap 137. Moreover, as depicted in FIG. 4, it can be seen that the inlet 141 and the outlet 142 of each guide channel 140 have different heights relative to the support ring 138. Assuming that the inlet 141 is positioned at the origin of a planar coordinate system, a Y-axis coordinate of the outlet 142 is greater than a Y-axis coordinate of the inlet 141, that is, the contour lines of the outlet 142 and the inlet 141 are different.

Next, an embodiment of the wind flow generating device 10 of the invention is described. Assuming that the electric motor 11 is not driven initially, that is, the rotatable fan blade 132 has not generated the airflow 50 yet. Once the driving shaft 112 is controlled to start, the driving shaft 112 drives the rotatable fan blade 132 to rotate to enable the rotatable fan blade 132 to generate the airflow 50. Thereafter, the guide frame 133 receives the airflow 50 from the rotatable fan blade 132 and guides the airflow 50 with the plurality of guide vanes 139, so that the airflow 50, after guided by the plurality of guide vanes 139, can flow along the motor housing 111 while being discharged from the air outlet gap 137.

According to the invention, the guide channel 140 is defined by any adjacent two of the plurality of guide vanes 139, and the inlet 141 and the outlet 142 of each guide channel 140 are positioned on different contour lines of the motor housing 111. After the rotatable fan blade 132 generates the airflow 50 and the airflow 50 enters the guide frame 133, the airflow 50 is directly guided by the plurality of guide vanes 139 towards a direction facing the motor housing 111 without reversing its path, thereby reducing the occurrence of turbulence of the airflow 50 particularly. In addition, after the airflow 50 is guided by the guide frame 133, the airflow 50 can dissipate heat from the motor housing 111 while flowing along the motor housing 111.

In an embodiment, referring again to FIG. 1, FIG. 2, FIG. 3, FIG. 4 and FIG. 5, each of the plurality of guide vanes 139 is provided with a guide lug 145 on a side facing the air outlet gap 137. The guide lug 145 is positioned at a joint of the guide vane 139 and the support ring 138, and the guide lug 145 is inclined from a side adjacent to the support ring 138 towards a side adjacent to the guide vane 139. Therefore, in addition to joining the guide vane 139 and the support ring 138, the guide lug 145 also guides the airflow 50 to flow along the guide vane 139. Furthermore, in an embodiment, the guide frame 133 comprises a plurality of support walls 146 for joining the support ring 138 and the plurality of guide vanes 139, each of the support walls 146 extending from the support ring 138 in a direction opposite to the rotatable fan blade 132, a height of each of the support walls 146 relative to the support ring 138 being configured in a manner corresponding to the design of the plurality of guide vanes 139, so that the inlet 141 and the outlet 142 of each of the guide channels 140 are positioned on different contour lines of the motor housing 111.

Referring again to FIG. 2, FIG. 3, FIG. 4 and FIG. 5, in an embodiment, the motor housing 111 includes an end cap 113 within the wind barrel 13 to prevent foreign matter in the airflow 50 from entering the interior of the electric motor 11, which reduces damage to the electric motor 11. Moreover, the end cap 113 is provided with an engagement ring 114 forming the air outlet gap 137. The engagement ring 114 is provided with a plurality of hollowed areas 115 respectively facing the outlet 142 of each of the guide channels 140. The plurality of hollowed areas 115 is formed at portions of the engagement ring 114 which are not coupled with the plurality of guide vanes 139, and the hollowed areas 115 are used for allowing the airflow 50 to be discharged from the wind barrel 13 after flow along the guide channels 140. In an embodiment, referring again to FIG. 4 and FIG. 5, each of the plurality of guide vanes 139 of the invention is not configured with constant overall curvature. Specifically, a curvature of each of the plurality of guide vanes 139 on a side facing the engagement ring 114 and at an end close to the rotatable fan blade 132 is smaller than the curvature of each of the plurality of guide vanes 139 on a side facing the engagement ring 114 and at an end close to the air outlet gap 137, so that each of the plurality of guide vanes 139 guides the airflow 50 towards the hollowed areas 115 after receiving the airflow 50. Moreover, in another embodiment, profiles of each of the plurality of guide vanes 139 on a side close to the motor housing 111 and a side opposite to the motor housing 111 are different. Further, each of the plurality of guide vanes 139 is inclined from a side opposite to the motor housing 111 towards a side close to the motor housing 111, thereby allowing the airflow 50 to flow along the motor housing 111 after each of the plurality of guide vanes 139 receiving the airflow 50, so that the motor housing 111 exchanges heat with the airflow 50.

Further, in an embodiment, referring to FIG. 1, FIG. 2, FIG. 3, FIG. 4 and FIG. 5, the guide frame 133 of the invention is fixedly coupled to the motor housing 111, and some of the plurality of guide vanes 139 are provided with a mounting lug 147 on the side facing the opening 136. The mounting lug 147 is positioned on a side of the guide channel 140 close to the air outlet gap 137. With respect to the guide frame 133 of the invention, the plurality of guide vanes 139 provided with the mounting lug 147 and those without the mounting lug 147 are arranged alternately, that is, any of the plurality of guide vanes 139 provided with the mounting lug 147 is adjacent to those without the mounting lug 147. Further, the mounting lug 147 is formed with a first through hole 148 through which a fixing member 51 is inserted, and the fixing member 51 is inserted into the first through hole 148 and then coupled with the engagement ring 114 to fix the guide frame 133 to the motor housing 111. As can be seen from the above, the motor housing 111 is coupled with the plurality of guide vanes 139 provided with the mounting lug 147 at least through the engagement ring 114.

In another embodiment, the support ring 138 includes a plurality of bearing blocks 149 and a plurality of support columns 150. The plurality of bearing blocks 149 is arranged on an inner side of the support ring 138 at intervals, that is, the plurality of bearing blocks 149 is arranged on a side of the support ring 138 close to the motor housing 111. Moreover, the plurality of support columns 150 is disposed on the inner side of the support ring 138 and between any adjacent two of the plurality of bearing blocks 149. With respect to the guide frame 133 depicted herein, the plurality of bearing blocks 149 and the plurality of guide vanes 139 without the mounting lug 147 are positioned on the inner side and the outer side of the support ring 138, respectively; likewise, the plurality of support columns 150 and the plurality of guide vanes 139 provided with the mounting lug 147 are positioned on the inner side and the outer side of the support ring 138, respectively. Moreover, the motor housing 111 is coupled with the support ring 138, and the end cap 113 of the motor housing 111 is provided with a plurality of assembly notches 116 provided for the plurality of bearing blocks 149 and the plurality of support columns 150, wherein the assembly notches 116 are shaped to be fitted with the plurality of bearing blocks 149 and the plurality of support columns 150. Further, each of the plurality of bearing blocks 149 is provided with a second through hole 151 at a side facing the assembly notch 116, through which a coupling member 52 is inserted, and the coupling member 52 is inserted through the second through hole 151 to be coupled with the assembly notch 116, so that the guide frame 133 can be stably assembled on the motor housing 111.

What is claimed is:

1. A wind flow generating device adapted to a hand dryer, comprising:

an electric motor, provided with a motor housing and a driving shaft; and a wind barrel, including a bowl, a rotatable fan blade provided in the bowl and connected with the driving shaft to generate an airflow in the bowl, and a guide frame provided in the bowl and fixed to the motor housing, wherein an air inlet hole is provided at a bottom of the bowl, and an air outlet gap is jointly defined by the motor housing and an opening of the bowl, the guide frame includes a support ring fixed to the motor housing and a plurality of guide vanes formed on the support ring at intervals and extending along a surface of the motor housing, any adjacent two of the plurality of guide vanes define a guide channel along the motor housing, an inlet and an outlet of each guide channel are positioned on different contour lines of the motor housing, and each guide channel guides the airflow to be discharged from the air outlet gap;

wherein the support ring is provided with a plurality of bearing blocks arranged on an inner side of the support ring at intervals, and a plurality of support columns arranged on the inner side of the support ring and between any adjacent two of the plurality of bearing blocks, respectively, and each of the plurality of bearing blocks is formed with a second through hole through which a coupling member is inserted;

wherein the motor housing is provided with an end cap within the wind barrel, the end cap being formed with a plurality of assembly notches provided for the bearing blocks and the support columns, respectively.

2. The wind flow generating device adapted to the hand dryer according to claim 1, wherein a side of each of the plurality of guide vanes, facing the air outlet gap, is provided with a guide lug at a joint of the guide vane and the support ring.

3. The wind flow generating device adapted to the hand dryer according to claim 2, wherein some of the plurality of guide vanes are provided, on a side facing the opening of the bowl, with a mounting lug at an end of the guide channel closest to the air outlet gap, and the mounting lug is formed with a first through hole through which a fixing member is inserted.

4. The wind flow generating device adapted to the hand dryer according to claim 3, wherein a curvature of each of the plurality of guide vanes on a side facing the air outlet gap and at an end closest to the rotatable fan blade is smaller than the curvature of each of the plurality of guide vanes on a side facing the air outlet gap and at an end closest to the air outlet gap.

5. The wind flow generating device adapted to the hand dryer according to claim 3, wherein in each of the plurality of guide vanes, a profile closest to the motor housing is different from a profile opposite to the motor housing.

6. The wind flow generating device adapted to the hand dryer according to claim 5, wherein the profile opposite to the motor housing is inclined toward the motor housing.

7. The wind flow generating device adapted to the hand dryer according to claim 1, wherein the motor housing is provided with an end cap positioned within the wind barrel, the end cap comprises an engagement ring forming the air outlet gap, and the engagement ring is coupled to some of the plurality of guide vanes.

8. The wind flow generating device adapted to a hand dryer according to claim 7, wherein a plurality of hollowed areas respectively facing the outlets of the guide channels are formed on the engagement ring.

9. The wind flow generating device adapted to a hand dryer according to claim 1, wherein the guide frame comprises a plurality of support walls joining the support ring and the plurality of guide vanes.

* * * * *